United States Patent [19]

Angelis

[11] 4,082,408

[45] Apr. 4, 1978

[54] ELECTRIC FUSE HOLDER

[75] Inventor: John G. Angelis, Hampton, N.H.

[73] Assignee: Gould, Inc., Newburyport, Mass.

[21] Appl. No.: 771,816

[22] Filed: Feb. 24, 1977

[51] Int. Cl.[2] ..... H01R 9/22

[52] U.S. Cl. ..... 339/198 G; 339/198 H

[58] Field of Search ..... 339/65, 66 R, 66 M, 339/198 R, 198 G, 198 GA, 198 H, 198 K, 198 N

[56] References Cited

U.S. PATENT DOCUMENTS

| | | | |
|---|---|---|---|
| 3,181,974 | 5/1965 | La Barbera | 339/198 G |
| 3,810,077 | 5/1974 | Salzer | 339/252 F |
| 3,822,416 | 7/1974 | Haag | 339/198 H |
| 3,993,395 | 11/1976 | Taylor | 339/19 BH |

FOREIGN PATENT DOCUMENTS

| | | | |
|---|---|---|---|
| 596,251 | 7/1959 | Italy | 339/198 G |
| 66,587 | 9/1913 | Switzerland | 339/198 G |

*Primary Examiner*—Mark S. Bicks
*Attorney, Agent, or Firm*—Erwin Salzer

[57] ABSTRACT

An electric fuse holder of the modular kind, i.e. formed by combining a plurality of identical fuse holder units. The fuse holder units are shaped in such a way that they can be joined together under pressure of wedge action merely by virtue of their geometry or configuration into a composite or multipolar fuse holder, i.e. in the absence of any additional fastener means.

7 Claims, 8 Drawing Figures

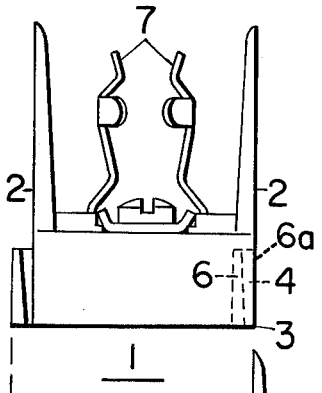
FIG. 1
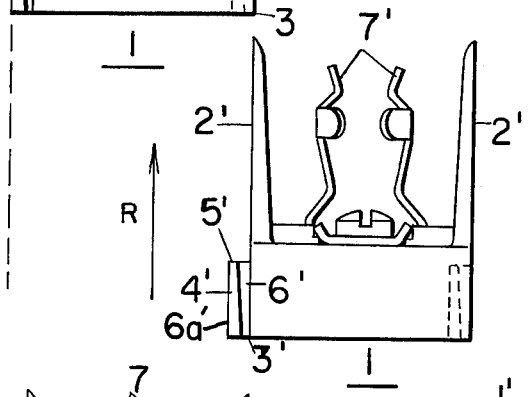
FIG. 1a
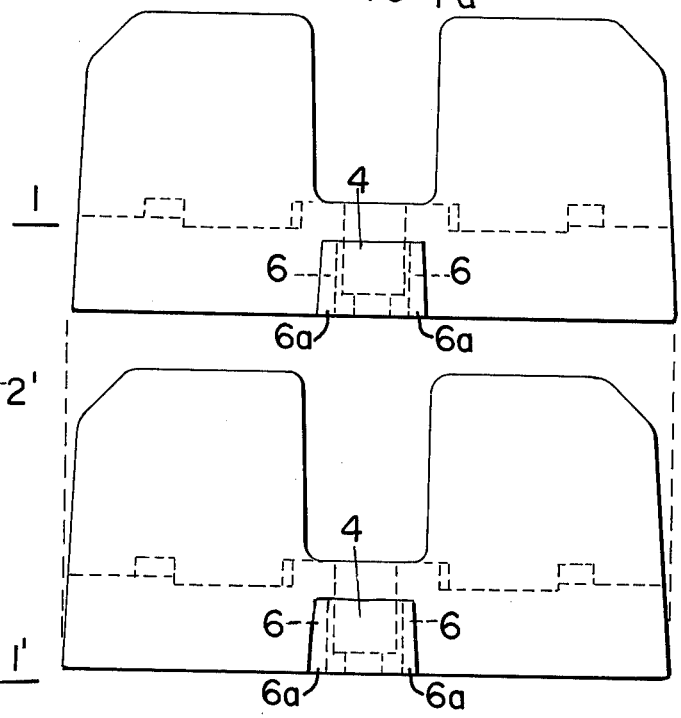
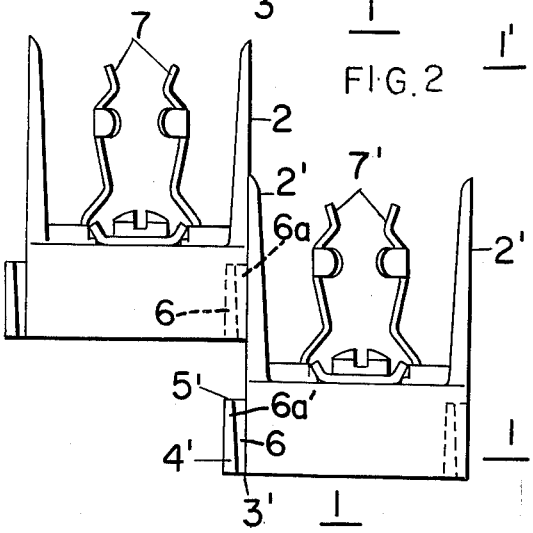
FIG. 2
FIG. 2a
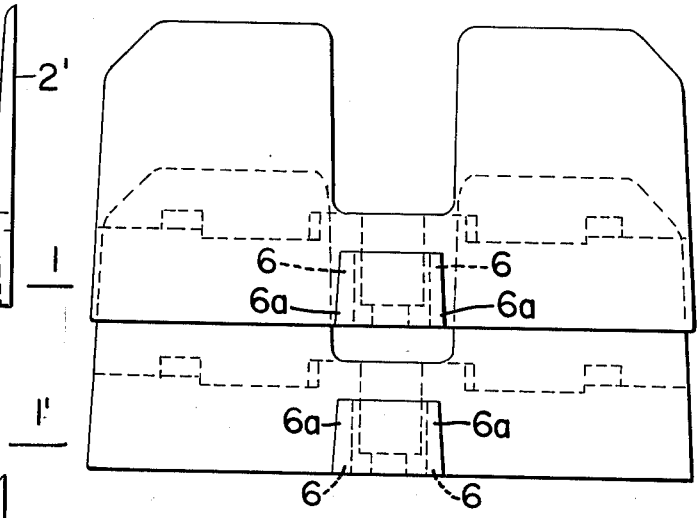
FIG. 3
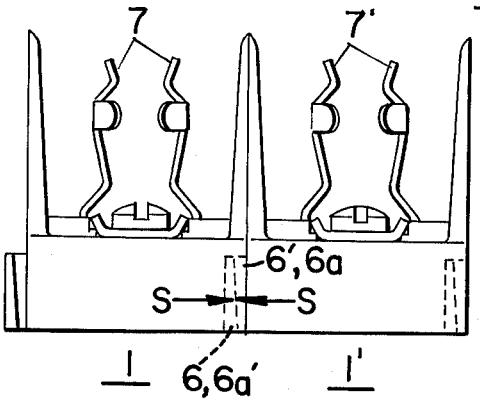
FIG. 3a
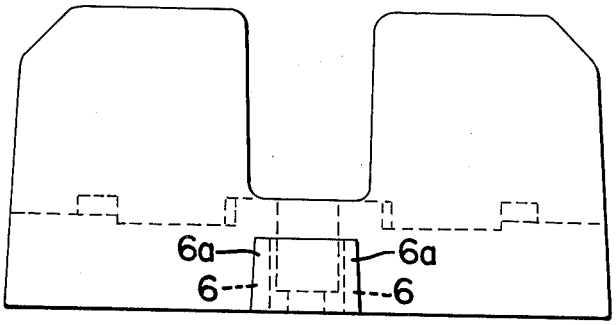

ELECTRIC FUSE HOLDER

BACKGROUND OF THE INVENTION

It is well known to assemble single identical fuse holders to form multipolar, or composite, fuse holders.

A multipolar or composite fuse holder is shown, for instance, in U.S. Pat. No. 3,171,002 to J. D. Kinnear, 02/23/65 ELECTRICAL FUSE MOUNTING. In the instance of Kinnear the units are nested into composites secured to a mounting panel. The mounting panel is the means for joining the individual fuse holder sections to a unitary structure. This structure is not modular since it comprises two different kinds of sections, namely end sections having lugs for fastening screws and normal sections without such lugs.

U.S. Pat. No. 3,810,077 to E. Salzer 05/07/74 for FUSE HOLDERS relates to a truly modular multipolar fuse holder, i.e. one wherein the individual fuse holder units are identical. This fuse holder requires, however, special fastener means, e.g. cement, for integrating several separate fuse holder units into a unitary structure.

The present invention refers to a modular fuse holder structure, i.e. one consisting of identical sub-units, which are capable of being assembled under pressure of wedge action into a multi-polar or composite structure without additional fastener means of any sort.

SUMMARY OF THE INVENTION

This invention relates to a modular fuse holder unit comprising a substantially prismatic fuse clip supporting block of synthetic resin. Said block is planar at two opposite sides thereof except for a planar projection on one of said sides and a planar recess on the other of said sides. Said projection converges in upward direction and defines a first pair of grooves open at one of the lower longitudinal edges of said block. Said first pair of grooves, or the depth thereof, slightly increases in upward direction and said recess converges likewise in upward direction and defines a second pair of grooves open at one of the lower longitudinal edges of said block. Said second pair of grooves, or the depth thereof, decreases in upward direction. Said recess and said second pair of grooves and said projection and said first pair of grooves are complementary positives and negatives of each other. As a result of this geometry, or configuration, said block is capable of being joined under pressure of wedge action with other identical blocks in the absence of any additional fastener means.

BRIEF DESCRIPTION OF THE DRAWINGS

FIG. 1 and FIG. 1*a* are an end view and a side view, respectively, of two separate blocks embodying this invention;

FIG. 2 and FIG. 2*a* are an end view and a side view, respectively, of two blocks embodying this invention in the process of being joined;

FIG. 3 and FIG. 3*a* are an end view and a side view, respectively, of two fuse clip supports upon having been fully joined;

DESCRIPTION OF PREFERRED EMBODIMENT

Figure 4:
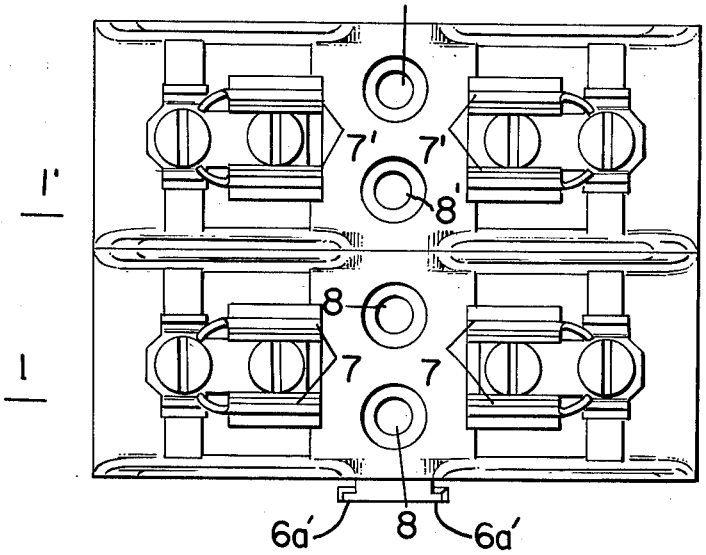
FIG. 4 is a top plan view of two joined blocks or fuse clip supports.

Referring now to the drawings and particularly to FIGS. 1, 1*a* and 2, 2*a* and 3, 3*a* thereof, FIGS. 1, 2 and 3 show end views of a fuse holder, or fuse clip support, embodying this invention in three different positions, and FIGS. 1*a*, 2*a* and 3*a* are side elevations of the structure shown in FIGS. 1, 2 and 3. In FIGS. 1–3 two fuse holder elements 1 and 1' are shown which are intended to fit together at the longitudinal surfaces 2, 2' of the sockets thereof. The surfaces 2 and 2' of fuse holder elements 1 and 1' are strictly planar except at a single point of each of said surfaces 2, 2' of said socket situated immediately adjacent a lower lateral edge 3, 3' thereof. As shown in FIG. 1 surface 2' has a projection 4'. Projection 4' is wider at its lower end situated adjacent edge 3' than at its upper end 5'. Projection 4 is wider at its front than at its base. Hence, a pair of grooves 6' is formed, one on each side of projection 4'. Said pair of grooves 6' are open at their lower ends adjacent edge 3'. They are also open at their upper ends remote from edge 3'. The geometry of projection 4' is also fully apparent from FIG. 5. As shown in the latter figure the width "*a*" at the bottom of projection 4' slightly exceeds its width"*b*" on the top thereof. The depth "*c*" of groove 6' at the top thereof exceeds their depth "*d*" of grooves 6' at the bottom thereof. In other words, projection 4' is a double wedge, or is capable of performing a double wedge action since its front surface decreases — $a > b$ — and its grooves 6' have an increasing cross-section from the bottom 3' to the top thereof. Arrow R indicates the direction which will hereafter be referred-to as upward direction.

Grooves 6' are bounded by straight ribs or overhangs 6*a'*. The cross-sectional area of these ribs changes inversely to that of grooves 6', i.e. it is larger near edge 3' and decreases in upward direction. Projections 4' are supposed to engage negatives thereof, i.e. recesses 4. Each recess 4 is, therefore, planar, wider at its lower than at its upper end, has a pair of lateral grooves 6 bounded by a pair of ribs or overhangs 6*a*. The cross-sectional area of grooves 6 is widest at their lower ends near edge 3', and decreases in upward direction, while that of ribs or overhangs 6*a* changes inversely to that of grooves 6.

Figure 5:
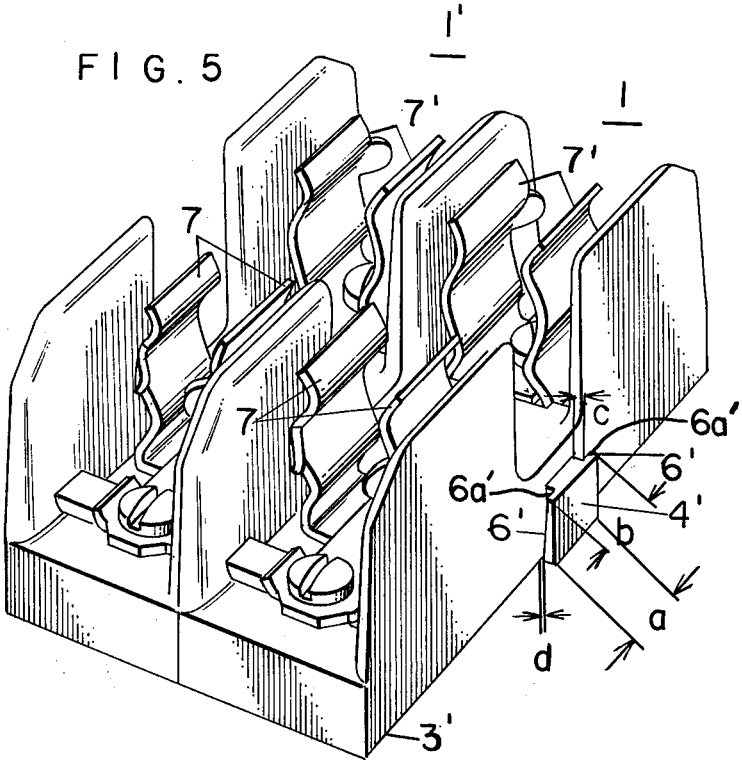
FIG. 5 is an isometric view of the structure of FIG. 4.

Fuse clips 7 and 7' are arranged between the side walls 2'. These clips have not been shown in FIGS. 1*a*, 2*a* and 3*a* since they are not relevant to what these figures intend to show. FIGS. 4 and 5 show fuse clips 7 and 7' in considerable detail.

Fuse holder element 1 has a planar lateral surface 2 which is only interrupted by a recess 4. Recess 4 is narrower at the front than at the base thereof, so as to form a pair of grooves 6, one on each side thereof. Grooves 6 are open at their lower ends adjacent edge 3 and closed at their upper end remote from edge 3. The cross-sectional area at the lower ends of grooves 6 adjacent edge 3 is larger than their cross-sectional area at the end thereof remote from edge 3. In other words, grooves 6 converge in upward direction.

Recess 4 and grooves 6 are negatives of projection 4' and grooves 6'. When fuse holder element 1' is moved upwardly from the position shown in FIGS. 1 and 1*a* through the position shown in FIGS. 2 and 2*a* to the position shown in FIGS. 3 and 3*a* both fuse holder elements interlock mutually and take the appearance of one single double pole fuse holder, as shown in FIG. 4 and FIG. 5. This interlocking action is effected under pressure of wedge action and in the absence of any additional fastener means.

It will be apparent from all the figures that each fuse holder element 1, 1' is provided with one projection 4' and one recess 4. This makes it possible to stack an indefinite number of fuse holder elements to form an integral multipolar fuse holder structure.

As shown in FIG. 2 each fuse holder element or fuse clip carrier is provided with a pair of holes 8 and 8' intended to receive screws for attaching the fuse holder to an appropriate support.

It will be apparent from the figures that each of the fuse clip carriers is provided with four congruent partitions whose cross-sectional area decreases toward the exposed edges thereof. Partition between phases have twice the thickness as partitions at the end of a stack.

The materials of which parts 1 and 1' are made must have a certain give since each projection 4' is compressed in two directions at right angles when it is inserted into one of recesses 4. When the right material is used there is no visible gap between the constituent parts of a fuse holder according to this invention. Glass filled hardened polyester resins have been successfully tried.

As mentioned above, the geometry described is capable of exerting two wedge actions which are at right angles to each other. How these wedge actions are obtained will again be described in more detail.

It will be apparent that each of grooves 6' is bounded by a first pair of ribs or overhangs *6a'* which form wedges increasing in cross-section from edge 3' in upward direction (FIG. 5). Similarly, each of grooves 6 is bounded by a second pair of ribs or overhangs *6a* which form wedges increasing in cross-section from lower edge 3 in upward direction (FIG. 1).

A first wedge action occurs on account of the fact that both the planar front surfaces of projections 4' and the recesses into which they enter, converge in upward direction. A second wedge action at right angles to said first wedge action is achieved on account of the fact that the cooperating surfaces of the ribs or overhangs *6a'* and *6a* are wedges, i.e. that *6a'* decreases and *6a* increases in cross-section in upward direction. In FIG. 3 arrows S have been applied to indicate the directions of the wedge action effected by engagement of groove 6 by ribs or overhangs *6a'* and engagement of groove 6' by ribs or overhangs forming part of recess 4. FIG. 3 shows also that ribs or overhangs *6a'* decrease in cross-section from edge 3' in upward direction and that ribs or overhangs *6a* increase in cross-section in upward direction.

I claim as my invention:

1. A modular fuse holder unit comprising a. a substantially prismatic block of a synthetic resin supporting a pair of fuse clips;

b. said block being planar on two opposite sides thereof except for a planar projection on one of said sides and a planar recess on the other of said sides, both said projection and said recess beginning at the lower edge of said block and extending in upward direction;

c. said projection slightly converging in upward direction and defining a first pair of grooves on both lateral sides thereof whose depth slightly increases in upward direction and are bounded by a first pair of ribs whose thickness slightly decreases in upward direction;

d. said recess slightly converging in upward direction and defining a second pair of grooves on both lateral sides thereof whose depth slightly decreases in upward direction and are bounded by a second pair of ribs whose thickness slightly increases in upward direction; and e. said projection and said first pair of grooves and said recess and said second pair of grooves being complementary positives and negatives whereby said block is capable of being joined under wedge pressure with other identical blocks by engagement of said recess in one of said blocks by said projection in another of said blocks and by engagement of said second pair of grooves in one of said blocks by said first pair of ribs in another of said blocks.

2. A modular fuse holder unit comprising a. a support for a pair of fuse clips;

b. one side of said support having a planar projection beginning at an edge region thereof which is wider at the front than at the rear thereof so as to form a first pair of grooves, one to each side of said projection, said projection converging in upward direction and the cross-sectional area of said first pair of grooves increasing in upward direction, and are bounded by a first pair of ribs whose thickness decreases in upward direction;

c. the opposite side of said support having a planar recess beginning at an edge region thereof which is wider at the rear than at the front thereof so as to form a second pair of grooves, one to each side of said recess, said recess converging in upward direction and the cross-sectional area of said second pair of grooves decreasing in upward direction, and are bounded by a second pair of ribs whose thickness increases in upward direction;

d. said recess and said second pair of grooves being complementaries of said projection and said first pair of grooves whereby said support is capable of being joined under wedge pressure with other identical supports by a first wedge action achieved by engagement of said recess in one of said supports by said projection of another of said supports, and by a second wedge action achieved by engagement of said first pair of grooves of one of said supports by said second pair of ribs of another of said supports.

3. A fuse holder as specified in claim 2 wherein said fuse clip carriers are made of a hardened glass-filled polyester resin.

4. A multipolar modular fuse holder comprising a plurality of fuse clip carriers shaped to fit together at the longitudinal surfaces thereof, said fuse holder comprising the novel features that a. the lateral surfaces of each fuse clip carrier are planar except at one single point of said surfaces situated immediately adjacent a lower lateral edge thereof;

b. said one point of one of said lateral surfaces is formed by a planar projection decreasing in width in upward direction, said projection being wider at the front than on the base thereof thereby defining a first pair of grooves, one to each side thereof, a first pair of ribs each bounding one of said first pair of grooves, said first pair of grooves being open at the lower ends thereof and diverging in upward direction and said first pair of ribs converging in upward direction;

c. said one point on the other of said lateral surfaces is formed by a planar recess decreasing in width in upward direction, said recess being wider at the base than at the front thereof thereby defining a second pair of grooves and a second pair of ribs each bounding one of said second pair of grooves; said second pair of grooves being open at the lower ends thereof and converging in upward direction and said pair of ribs diverging in upward direction;

d. said projection and said first pair of grooves and said recess and said second pair of grooves being complementary positives and negatives whereby said fuse clip carriers are being joined under pressure by a first wedge action achieved by engagement of said recess in one of said supports by said projection in another of said supports and by a second wedge action achieved by engagement of said first pair of grooves in one of said supports by said second pair of ribs in another of said supports.

5. A fuse holder as specified in claim 4 wherein each of said fuse clip carriers is provided with four congruent partitions whose cross-sectional area decreases toward the exposed edges thereof.

6. A modular fuse holder comprising a. a substantially prismatic block of synthetic resin for supporting a pair of fuse clips;

b. a pair of fuse clips supported by said block;

c. said block being planar at two opposite sides thereof except for a substantially planar projection on one side thereof and a substantially planar recess on the other side thereof, said projection and said recess both converging in upward direction so as to exert a first wedge action when said projection of one fuse holder engages said recess in another fuse holder; and d. the end surface of said projection being larger than the base thereof so as to form a first pair of lateral overhangs and a first pair of lateral grooves behind said first pair of overhangs increasing in cross-sectional area in upward direction, and the end surface of said recess being larger than the open end thereof so as to form a second pair of lateral overhangs decreasing in cross-sectional area in upward direction, whereby a second wedge action is exerted at right angles to said first wedge action when said first pair of lateral overhangs of one fuse holder engages said second pair of overhangs of another fuse holder.

7. A coupled pair of modular fuse holders comprising a. a substantially identical pair of prismatic blocks of synthetic resin each supporting a pair of fuse clips;

b. each of said pair of blocks being planar on juxtaposed sides thereof except for a substantially planar projection on one of said sides extending upwardly from an edge thereof and arranged approximately at the middle of said one of said sides, and except for a recess having a substantially planar bottom on the other of said sides extending upwardly from an edge thereof and arranged approximately at the middle of said other of said sides;

c. the end surface of said projection being larger than the base thereof so as to form a first pair of lateral ribs and a first pair of grooves behind said first pair of ribs, and the end surface of said recess being larger than the open end thereof so as to form a pair of lateral ribs and a second pair of grooves behind said second pair of ribs; and d. said projection engaging said recess and said first pair of ribs engaging said second pair of grooves;

e. said projection and said recess converge in upward direction; and f. wherein the cross-sectional area of said first pair of grooves increases and the cross-sectional area of said second pair of grooves decreases in upward direction.

* * * * *